United States Patent [19]

Mazza

[11] 4,287,953

[45] Sep. 8, 1981

[54] METHOD OF REMOVING CONDUIT FROM CURVED BOREHOLE

[75] Inventor: Raymond L. Mazza, Morgantown, W. Va.

[73] Assignee: Conoco, Inc., Ponca City, Okla.

[21] Appl. No.: 157,909

[22] Filed: Jun. 9, 1980

[51] Int. Cl.[3] ..... E21B 31/00

[52] U.S. Cl. ..... 166/301; 166/315; 175/61

[58] Field of Search ..... 166/301, 178, 98, 73, 166/99, 67, 315, 50; 175/61, 62

[56] References Cited

U.S. PATENT DOCUMENTS

| | | | |
|---|---|---|---|
| 2,956,626 | 10/1960 | Hall | 175/61 X |
| 3,042,125 | 7/1962 | Duncan | 175/61 X |
| 3,104,707 | 9/1963 | Overly | 166/301 |
| 3,236,307 | 2/1966 | Brown | 166/301 |
| 3,342,266 | 9/1967 | Le Blanc | 166/301 |
| 4,003,440 | 1/1977 | Cherrington | 175/61 |

*Primary Examiner*—Stephen J. Novosad
*Attorney, Agent, or Firm*—Richard W. Collins

[57] ABSTRACT

A method for removing a conduit from a curved borehole by applying a compression load to the conduit to cause it to bend away from the inside of the borehole curve.

3 Claims, 2 Drawing Figures

20
14
19
15
16

16
20
10
11
18
14

METHOD OF REMOVING CONDUIT FROM CURVED BOREHOLE

BACKGROUND OF THE INVENTION

In drilling through subterranean formations, the borehole, either accidently or by design, frequently is not straight. In drilling wells, for instance, the borehole will sometimes assume a curved path, and in other cases a deviated borehole is intentionally drilled. In drilling generally horizontal boreholes into mineral formations, the initial part of the borehole often is intentionally caused to assume a curved path.

In some cases, removal of drillpipe, tubing or casing from a curved borehole is difficult because tension applied to the conduit causes it to bind against the inside of the curved portion of the borehole. This problem often results in lost production time and/or repair, and in some cases stuck pipe results in loss of use of the borehole.

Prior to this invention, there was no satisfactory way to remove pipe from a curved borehole if the common prior art method of removing pipe by pulling from the surface end of the pipe was not successful.

SUMMARY OF THE INVENTION

According to the present invention, a method of removing pipe from a curved borehole is provided. The method involves inserting a settable plug in the pipe beyond the curved portion of the borehole, setting the plug, pulling on the set plug to apply a compression load to the pipe, and then pulling the pipe from the borehole.

DESCRIPTION OF THE PREFERRED EMBODIMENTS

Figures 1, 2:
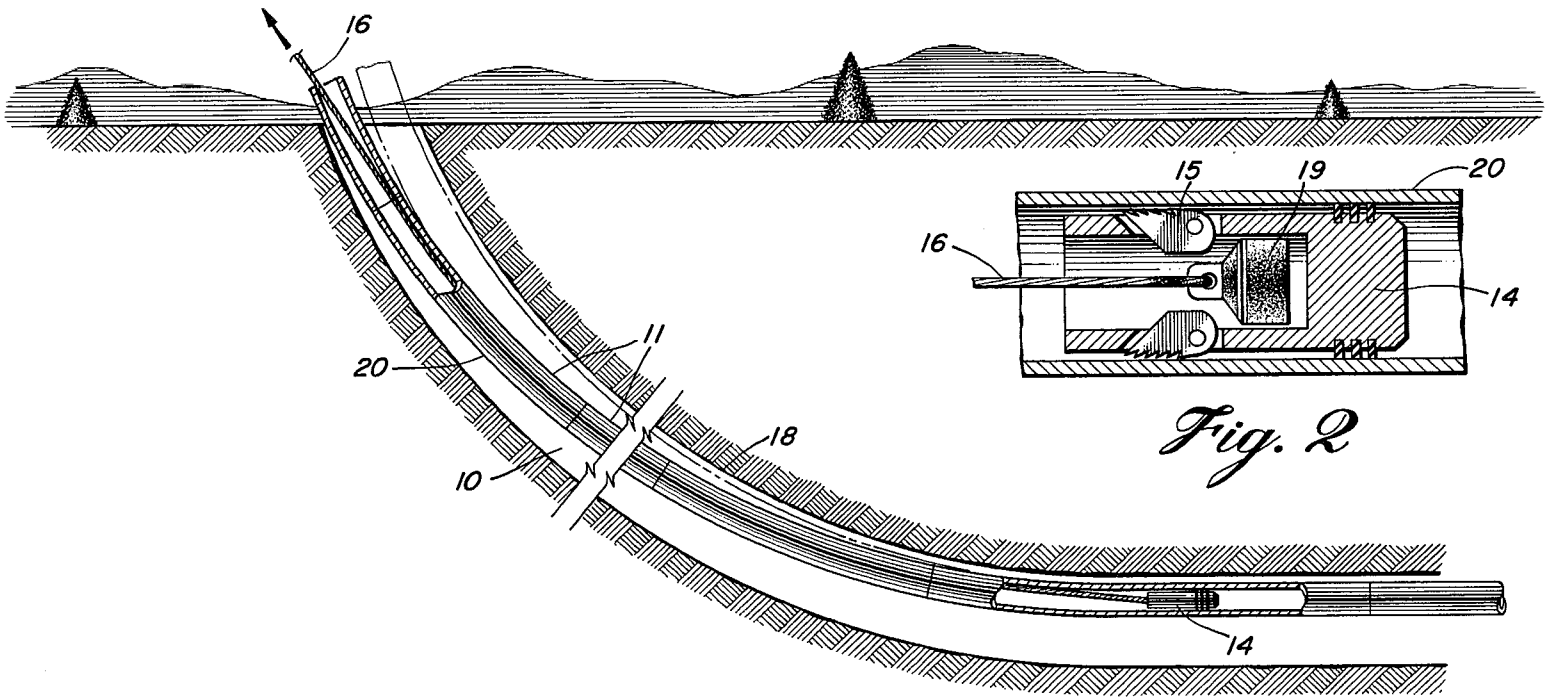
FIG. 1 is an illustration of a conduit in a curved subterranean borehole, partially cut away to illustrate use of a retrieval plug in accordance with the invention.
FIG. 2 is a detailed view, partially in cross section, of a settable retrieval plug inside a pipe section.

The method of the invention will be described by reference to the drawings.

FIG. 1 shows a curved subterranean borehole 10. The borehole may be for any purpose and of any length and diameter. Typical boreholes for which the invention may be applicable are oil, gas or water wells, underground pipelines, cable conduits, etc. Also, degasification wells drilled into coal seams in advance of mining may require the method of the invention.

An elongated conduit 20 comprised of threadedly connected pipe sections 11 extends into borehole 10. A settable plug 14 (FIG. 2) is designed to be pumped down conduit 20 to a position beyond at least a portion of the curved part of borehole 10, as shown in FIG. 1. Settable plug 14 includes pivotal gripping members 15 which allow plug 14 to move freely down conduit 20 but which grip the inside of a pipe section when cable 16 attached to insert 19 is pulled.

Once it is desired to remove conduit 20 from borehole 10 for whatever reason, the normal procedure would be to pull on conduit 20 from the surface using conventional equipment. If borehole 10 is curved substantially, as shown in FIG. 1, pulling from the surface (or other working area) can cause conduit 20 to bind against the upper surface 18 of borehole 10, such that the conduit 20 can not be removed. In this case, retrieval plug 14 is inserted in conduit 20 and pumped down past the curved portion of borehole 10. A tension force is then applied to cable 16 attached to insert 19, causing insert 19 to bear against gripping members 15 thereby applying a compression load to conduit 20. Continued tension applied to cable 16 causes conduit 20 to bend away from upper surface 18 of borehole 10, and a pulling force applied to conduit 20 while simultaneously applying tension to cable 16 allows conduit 20 to be removed from the borehole.

The relative amounts of force applied to cable 16 and conduit 20 will depend on many factors, but retrieval of conduits from curved boreholes is greatly facilitated by this method.

I claim:

1. A method of removing a conduit from a curved borehole comprising:

(a) pumping a settable plug down said conduit to a position beyond at least a portion of the curved borehole;

(b) setting said plug against the interior of said conduit;

(c) applying a compression load to said conduit by applying tension to a cable attached to said plug; and (d) simultaneously with step (c) applying a pulling force to said conduit whereby removal of said conduit from said borehole is facilitated.

2. The method of claim 1 wherein said settable plug is set in said conduit at a point near the downhole end thereof.

3. The method of claim 1 wherein said borehole is a subterranean borehole.

* * * * *